US006370987B1

(12) United States Patent
Wilson, Jr. et al.

(10) Patent No.: US 6,370,987 B1
(45) Date of Patent: Apr. 16, 2002

(54) APPARATUS AND METHOD FOR PRECISELY CONTROLLING ANGULAR DISPLACEMENT OF A SOCKET

(75) Inventors: David Wilson, Jr., 4210 Peach Way, Boulder, CO (US) 80301; Harold A. Burdick, Longmont, CO (US)

(73) Assignee: David Wilson, Jr., Boulder, CO (US)

( * ) Notice: Subject to any disclaimer, the term of this patent is extended or adjusted under 35 U.S.C. 154(b) by 0 days.

(21) Appl. No.: 09/745,747

(22) Filed: Dec. 22, 2000

(51) Int. Cl.[7] ..... B25B 13/00
(52) U.S. Cl. ..... 81/58.2; 81/57.39; 192/46
(58) Field of Search ..... 81/57.14, 57.3, 81/57.39, 58.2; 192/43, 46; 74/111

(56) References Cited

U.S. PATENT DOCUMENTS

| | | | | |
|---|---|---|---|---|
| 470,954 A | | 3/1892 | Sinclair | |
| 851,120 A | | 4/1907 | Cowell | |
| 2,193,984 A | | 3/1940 | Rhinevault | |
| 2,711,111 A | | 6/1955 | Brame | |
| 2,712,256 A | | 7/1955 | Fish | |
| 2,803,980 A | | 8/1957 | Vogel | |
| 2,817,257 A | | 12/1957 | Kniser | |
| 3,564,953 A | | 2/1971 | Able | |
| 3,867,855 A | | 2/1975 | Seibert | |
| 4,429,597 A | | 2/1984 | Grabovac et al. | |
| 5,140,875 A | | 8/1992 | Kim | |
| 5,450,773 A | | 9/1995 | Darrah et al. | |
| 5,460,062 A | * | 10/1995 | Wilson | 81/57.3 X |
| 5,467,672 A | | 11/1995 | Ashby | |
| 5,522,285 A | | 6/1996 | Wilson, Jr. et al. | |
| 5,537,897 A | * | 7/1996 | Wilson | 81/58.2 X |
| 5,560,560 A | * | 10/1996 | Ezawa | 192/46 |
| 5,622,089 A | | 4/1997 | Gifford, Sr. | |
| 5,647,252 A | | 7/1997 | Miner | |
| 5,690,202 A | * | 11/1997 | Myers | 192/46 |
| 5,697,266 A | * | 12/1997 | Wilson | 81/57.14 |
| 5,738,192 A | | 4/1998 | Miner | |
| 5,979,273 A | | 11/1999 | Walton | |

OTHER PUBLICATIONS

Chironis, Nicholas P.; Mechanisms & Mechanical Devices Sourcebook; 1991; McGraw–Hill, Inc.; pp 74–76, 320, 321.

* cited by examiner

*Primary Examiner*—James G. Smith
(74) *Attorney, Agent, or Firm*—Harold A. Burdick

(57) ABSTRACT

Apparatus and methods for precision control of degree of socket rotation where desired degree of rotation exceeds about 360°. One embodiment of the apparatus includes a cam structure associable with an assembly for holding and driving the socket so that either forward or reversed rotation of the cam structure and the socket are coincident. The cam structure includes a circumferentially projecting cam face construct movable through a path of rotation and having first and second spaced stop surfaces oriented across the rotation path. A rotation limiting mechanism includes first and second units for limiting cam rotation in each direction of rotation. Each unit includes a barrier portion and an actuating portion, movement of the barrier portion into the rotation path initiated by interaction of the rotating cam face construct and the actuating portion. Contact between a stop surface of the cam face construct and a barrier portion of a unit after movement into the rotation path halts cam structure rotation and thus rotation of the associated socket.

29 Claims, 11 Drawing Sheets

APPARATUS AND METHOD FOR PRECISELY CONTROLLING ANGULAR DISPLACEMENT OF A SOCKET

FIELD OF THE INVENTION

This invention relates to apparatus and methods for controlling the extent of rotation of a socket, and, more particularly, relates to apparatus and methods for directly limiting angular displacement of a socket to a selected extent in excess of about 360°.

BACKGROUND OF THE INVENTION

Currently the assembly of equipment requires a vast array of different size fittings and/or other threaded connectors, each requiring application of a set amount of torque for proper securement.

Some presently utilized tool systems, for application in manipulating hydraulic fittings for example, employ transducers with electrical motor controlled nut runners capable of sensing the torque being applied through a socket to a tube nut to control torque application. Heretofore known hydraulic and/or pneumatic tools have utilized spring biased clutches to determine when a desired torque application has been reached. In such cases, sensing of a desired torque application to the threaded connector results in shut-off of power to the driver and thus cessation of motive force to the drive head having the socket located therein.

While widely utilized, these systems require that a specific driver be matched to an individual drive head for each nut size and torque application requirement. Moreover, accuracy of torque application in heretofore known systems is difficult to control due to the inertia of the moving gears and socket employed by the drive heads of such systems. Thus, most conventional pneumatic, hydraulic and/or electric tool systems employing heretofore known torque control schemes allow the drive head gears and/or socket to "coast", or rotate, beyond the point of ideal torque application after power application to the tool ceases.

Many threaded connector manufacturers have determined that the best way to secure their fasteners (tube nuts for high pressure fittings, for example) is to first hand tighten them and then continue beyond this initial set point by a selected additional angular displacement (referred to often as a specific additional number of "turns"). For example, it is quite common for tube nut torque specifications to be expressed as "hand tight plus one and one quarter turns" (i.e., 450° of additional angular displacement of the nut beyond finger tight).

As may be appreciated, the amount of torque required to achieve this specified additional angular displacement for properly securing a fastener varies greatly depending on the size of the fastener thus further complicating torque application control in the field. For example, a small fastener might require 30 foot-pounds to achieve the correct additional angular displacement, while a large fitting could require 130 foot-pounds or more to achieve the same degree of additional angular displacement. In addition, each fitting, and particularly fittings of different size, will present different tightening resistance characteristics, the resistance to tightening building rapidly after the fitting has been hand tightened. Such torque application differences require provision of multiple drive tools in the field. Moreover, the unpredictability of actual operational behavior of any specific fastener leads to frequent fastener failure in many applications, requiring reinstallations and thus increasing the expense of operations.

Since manufacturers often suggest or specify correct fitting application by a number of "turns" (or angular displacement) after finger tightening, it would be desirable to more directly control angular displacement instead of torque application. If driver power is adequate, such control would overcome the resistance of the fastener no matter the degree, and precisely stop fastener rotation at the exact selected displacement. To date, however, such direct angular displacement control system for use with pneumatic, hydraulic or electric powered threaded connector drive tools has not been suggested or achieved acceptance.

Finally, it would be desirable for the means of controlling correct application and tightening of threaded connectors to be built for association with the drive head of the tool and not into the driver so that any of the variety of drivers available could be utilized with the head. Further improvements in this regard could also still be utilized.

SUMMARY OF THE INVENTION

This invention provides apparatus and methods for precisely limiting angular displacement of a socket independent of particular operational torque application requirements, and in particular where extent of socket rotation desired is about equal to or exceeds 360°. The apparatus is configured to operate in at least one, and preferably both, directions of rotation, is adaptable for use with a variety of drive head sizes an/or configurations and thus driver applications (i.e., fluid or electrical drives), and is not-susceptible to socket "coasting" beyond the desired angular displacement and thus torque application. The apparatus operates precisely independent of particular size, type, or exhibited rotational resistance characteristics of a fastener being manipulated by the socket by directly controlling angular displacement of the socket rather than torque application.

The apparatus includes a rotatable structure having a circumferentially projecting construct rotatable through a path of rotation, the rotatable structure associable with a socket drive assembly so that rotation of the rotatable structure and rotation of the socket at the assembly are coincident. A unit is maintained adjacent to the rotatable structure, the unit having a first portion movable into and out of the path of rotation and a second portion at the path of rotation spaced from the first portion in a down-path direction corresponding to a first direction of rotation of the rotatable structure. The first portion interacts with the construct of the rotatable structure to halt rotation of the rotatable structure in the first direction of rotation when the first portion is in the path of rotation. The second portion of the unit is contactable by the construct of the rotatable structure moving in the first direction of rotation to effect movement of the first portion relative to the path of rotation.

In a now preferred embodiment of the apparatus, the construct of the rotatable structure includes first and second circumferentially projecting formations axially differentiated so that the formations rotate in substantially different planes through the path of rotation. The unit includes a biased member having the first portion thereat, a surface of the biased member being contactable by the first formation of the rotatable structure moving in a reverse direction of rotation when the biased member is in the path of rotation causing movement of the biased member against its bias relative to the path of rotation. The first portion interacts with the first formation of the construct of the rotatable structure to halt rotation in the first direction of rotation. The second portion of the unit includes a lobe positioned for contact by the second formation of the rotatable structure and a release positioned to capture and hold the first portion of the unit and to release the first portion responsive to contact of the lobe allowing biased movement of the first portion into the path of rotation.

The apparatus is preferably configured for limiting angular displacement of a slotted socket to a selected extent about equal to or in excess of 360° in both forward and reverse directions of rotation. In this case, the circumferentially projecting construct of the rotatable structure has first and second spaced surfaces rotatable through the path of rotation, an arrangement provided for limiting rotation of the rotatable structure to a selected extent about equal to or in excess of 360° in either of the forward or reversed directions of rotation.

The arrangement, a unitary element or multiple elements, includes first and second barrier portions and first and second actuating portions, the first barrier portion movable into and out of the path of rotation and the first actuating portion at the path of rotation spaced from the first barrier portion in a down-path direction corresponding to the forward direction of rotation of the rotatable structure. The first barrier portion interacts with the first surface of the construct of the rotatable structure to halt rotation of the rotatable structure in the forward direction of rotation when the first barrier portion is in the path of rotation, the first actuating portion contactable by the construct of the rotatable structure moving in the forward direction of rotation to effect movement of the first barrier portion into the path of rotation.

The second barrier portion is movable into and out of the path of rotation with the second actuating portion at the path of rotation spaced from the second barrier portion in a down-path direction corresponding to the reversed direction of rotation of the rotatable structure. The second barrier portion interacts with the second surface of the construct of the rotatable structure to halt rotation of the rotatable structure in the reversed direction of rotation when the second barrier portion is in the path of rotation, the second actuating portion contactable by the construct of the rotatable structure moving in the reversed direction of rotation to effect movement of the second barrier portion into the path of rotation.

The method of this invention, for controlling rotation of a socket to a selected extent in excess of about 360°, includes effecting coincident rotation of the socket and a cam having a surface oriented across a path of rotation. The cam is rotated past a barrier and into contact with a lobe to effect movement of the barrier into the path of rotation after passage of the surface of the cam. Cam rotation is continued until contact between the surface and the barrier halts rotation of the cam and thereby rotation of the socket, whereafter cam rotation is reversed to thereby effect movement of the barrier out of the path of rotation.

It is therefore an object of this invention to provide apparatus and methods for precisely controlling angular displacement of a socket.

It is another object of this invention to provide apparatus and methods for directly controlling angular displacement of a socket independent of particular operational torque application requirements.

It is another object of this invention to provide apparatus and methods for controlling angular displacement of a socket where extent of socket rotation desired equals or exceeds 360°.

It is another object of this invention to provide apparatus for controlling angular displacement of a socket that is configured to operate in at least one, and preferably both, directions of rotation, is adaptable for use with a variety of drive head sizes an/or configurations and thus driver applications, and is not susceptible to socket "coasting" beyond the desired angular displacement and thus torque application.

It is still another object of this invention to provide apparatus and methods for controlling angular displacement of a socket independent of particular size, type, or exhibited rotational resistance characteristics of a fastener being manipulated by the socket.

It is another object of this invention to provide an apparatus for limiting angular displacement of a socket, the socket held in an assembly including a drive for effecting rotation of the socket, the apparatus including a rotatable structure having a circumferentially projecting construct rotatable through a path of rotation, the rotatable structure associable with the assembly so that rotation of the rotatable structure and rotation of the socket are coincident, and a unit maintained adjacent to the rotatable structure, the unit having a first portion movable into and out of the path of rotation and a second portion at the path of rotation spaced from the first portion in a down-path direction corresponding to a first direction of rotation of the rotatable structure, the first portion interacting with the construct of the rotatable structure to halt rotation of the rotatable structure in the first direction of rotation when the first portion is in the path of rotation, the second portion of the unit contactable by the construct of the rotatable structure moving in the first direction of rotation to effect movement of the first portion relative to the path of rotation.

It is still another object of this invention to provide an apparatus for limiting angular displacement of a slotted socket to a selected extent about equal to or in excess of 360°, the slotted socket held in an assembly including a drive for effecting rotation of the socket, the apparatus including a rotatable structure having a circumferentially projecting construct with first and second spaced surfaces and rotatable through a path of rotation, the rotatable structure having a mount associable with the assembly so that rotation of the rotatable structure in either of forward or reversed directions is coincident with socket rotation in either of clockwise or counterclockwise directions, and rotation limiting means for limiting rotation of the rotatable structure to a selected extent about equal to or in excess of 360° in either of the forward or reversed directions of rotation, the rotation limiting means including first and second barrier portions and first and second actuating portions, the first barrier portion movable into and out of the path of rotation and the first actuating portion at the path of rotation spaced from the first barrier portion in a down-path direction corresponding to the forward direction of rotation of the rotatable structure, the first barrier portion interacting with the first surface of the construct of the rotatable structure to halt rotation of the rotatable structure in the forward direction of rotation when the first barrier portion is in the path of rotation, the first actuating portion contactable by the construct of the rotatable structure moving in the forward direction of rotation to effect movement of the first barrier portion into the path of rotation, the second barrier portion movable into and out of the path of rotation and the second actuating portion at the path of rotation spaced from the second barrier portion in a down-path direction corresponding to the reversed direction of rotation of the rotatable structure, the second barrier portion interacting with the second surface of the construct of the rotatable structure to halt rotation of the rotatable structure in the reversed direction of rotation when the second barrier portion is in the path of rotation, the second actuating portion contactable by the construct of the rotatable structure moving in the reversed direction of rotation to effect movement of the second barrier portion into the path of rotation.

It is yet another object of this invention to provide a method for controlling rotation of a socket to a selected extent in excess of about 360° includes the steps of effecting coincident rotation of the socket and a cam having a surface oriented across a path of rotation, rotating the cam past a barrier and into contact with a lobe to effect movement of the barrier into the path of rotation after passage of the surface of the cam, continuing cam rotation until contact between the surface and the barrier halts rotation of the cam and thereby rotation of the socket, and reversing cam rotation to thereby effect movement of the barrier out of the path of rotation.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiments of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figure 1:
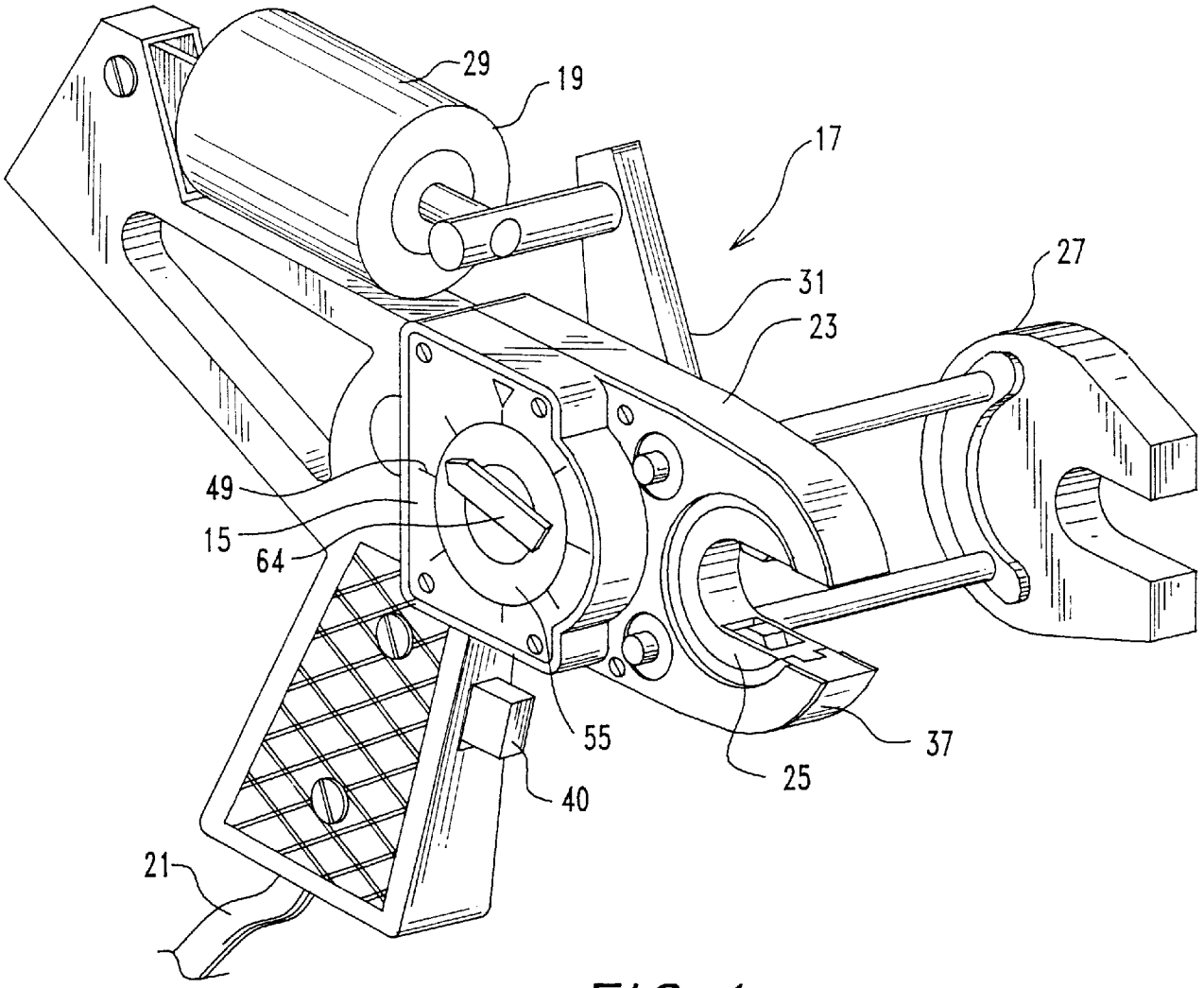
FIG. 1 is a perspective view of the apparatus of this invention applied to a slotted socket drive assembly.
Figure 2:
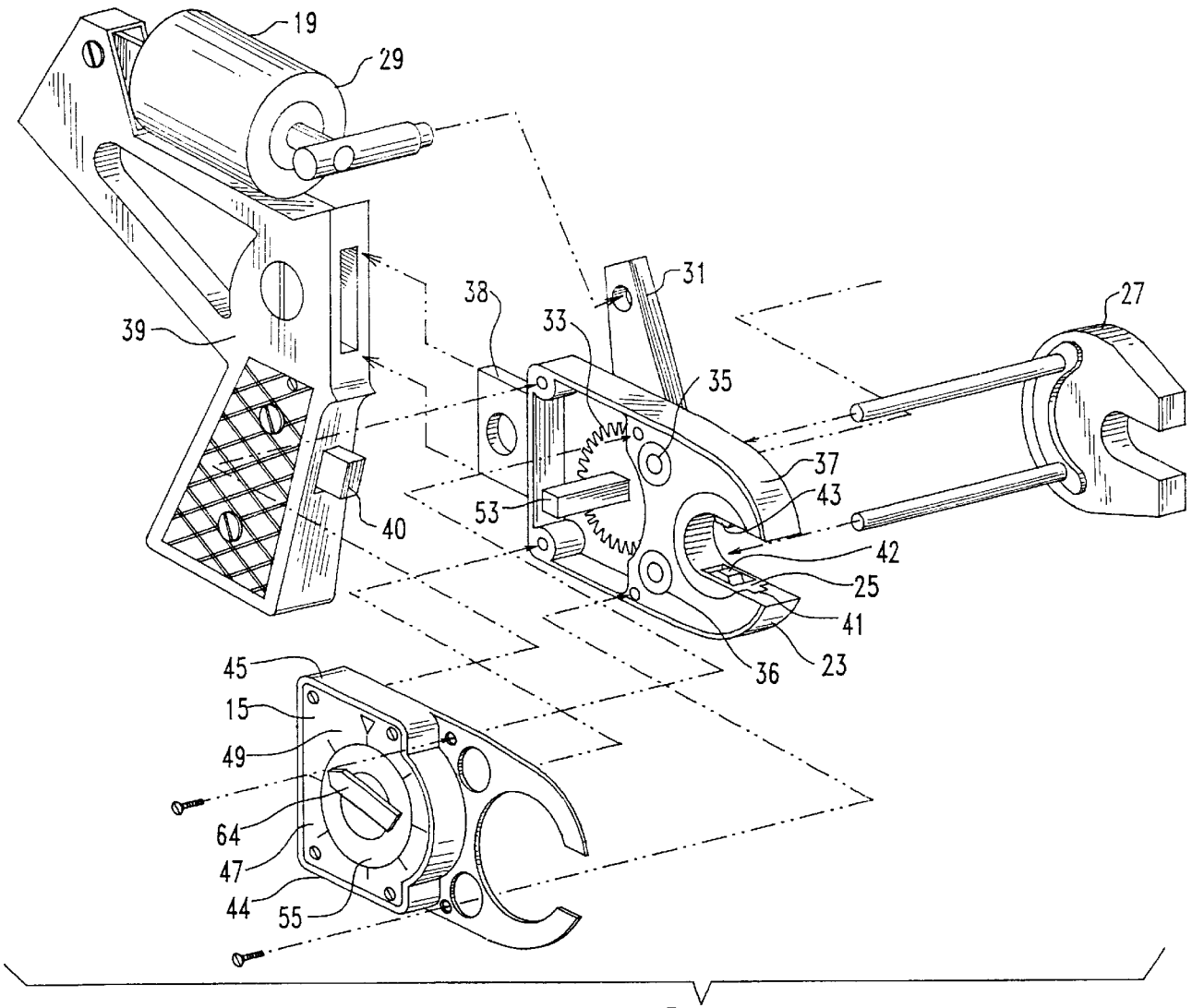
FIG. 2 is an exploded perspective view of the combination illustrated in FIG. 1.

Apparatus 15 of this invention is illustrated in FIGS. 1 and 2 applied with socket and drive assembly 17. Assembly 17 includes fluid driven ratchet driver 19 of standard operational design (pneumatic or hydraulic through supply 21 line) powering gear driven socket wrench head 23 having a slotted socket 25 thereat. Torque reaction unit 27 (as described in U.S. Pat. No. 5,460,062, for example) and/or other devices known to those skilled in the art may be employed in such an assembly (for example, the fitting orientation guide or the like as described in U.S. Pat. No. 5,697,266).

While the apparatus of this invention will be illustrated herein for use in a particular socket drive assembly application, it is to be realized that the apparatus could be applied with a variety of socket drive assembly applications, including those adapted for motor driven units with various gear drive arrangements or those adapted for more direct socket drive, and with any type of socket used with a powered drive arrangement, slotted or otherwise.

As is conventional, ratchet driver 19 includes drive piston assembly 29 linked with ratchet arm 31 connected with a bi-directional ratchet gear (not shown) at wrench head 23. As shown in FIG. 2, head 23 includes a main drive gear 33 and idler gears 35 and 36 in housing 37 (as shown in U.S. Pat. No. 5,460,062, for example), the head being mountable at mounting flange 38 in handle 39 having on/off valve control 40 associated therewith. Slotted socket 25 used in this particular application includes peripheral gear face 41 engageable at idler gears 35 and 36, dogs 42 and 43 provided to allow fitting rotation with the socket in one direction while allowing socket rotation in the opposite direction without fitting movement (see U.S. Pat. No. 5,537,897). This arrangement is particularly useful for line fittings and provides for more simplified reset of the slot in socket 25 relative to the slot in housing 37 after a fastener has been driven.

Figure 3:
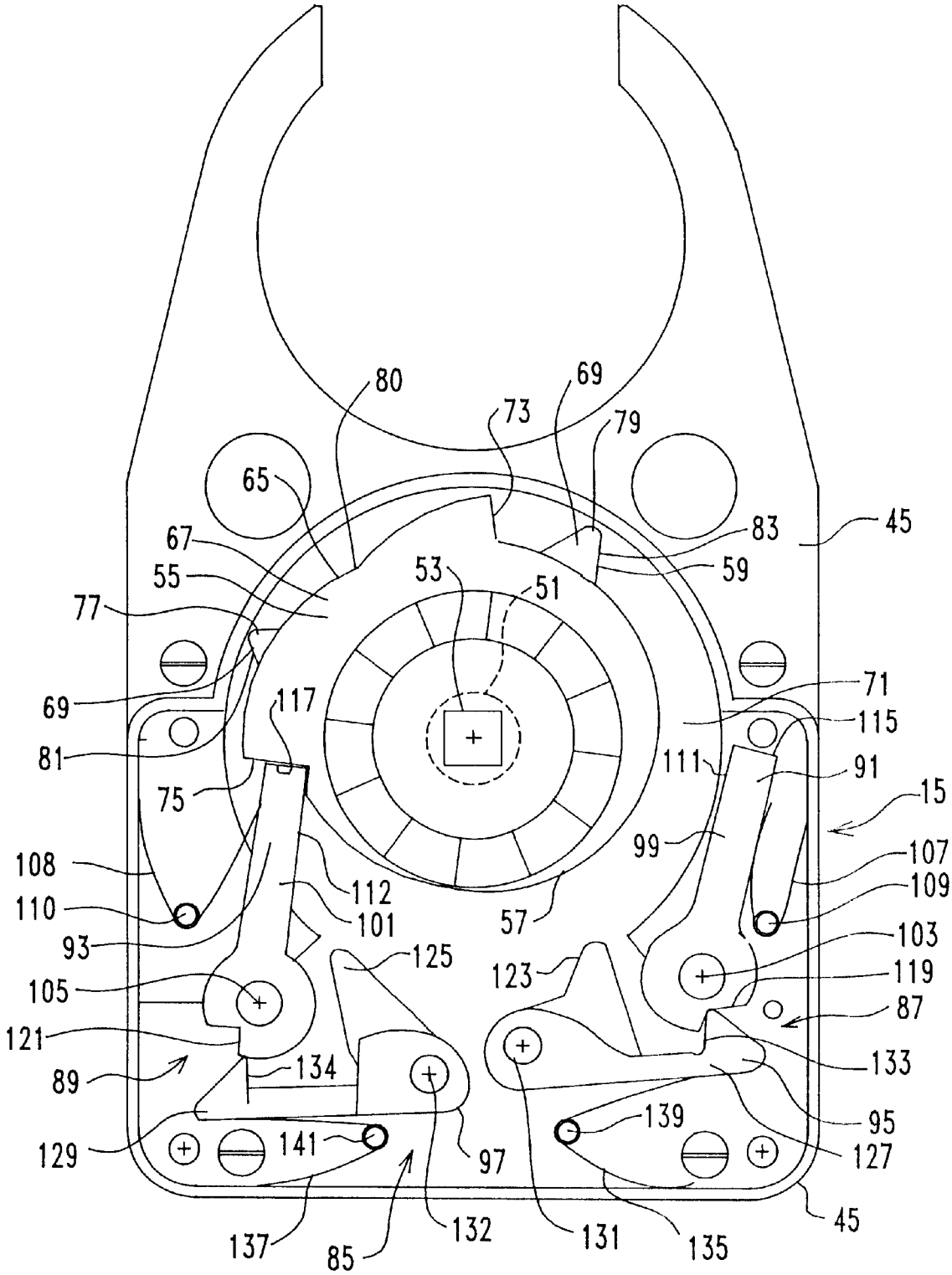
FIG. 3 is a top plan view of a first (and presently preferred) embodiment of an apparatus in accord with this invention particularly adapted for limiting socket rotation to 450°.
Figure 4:
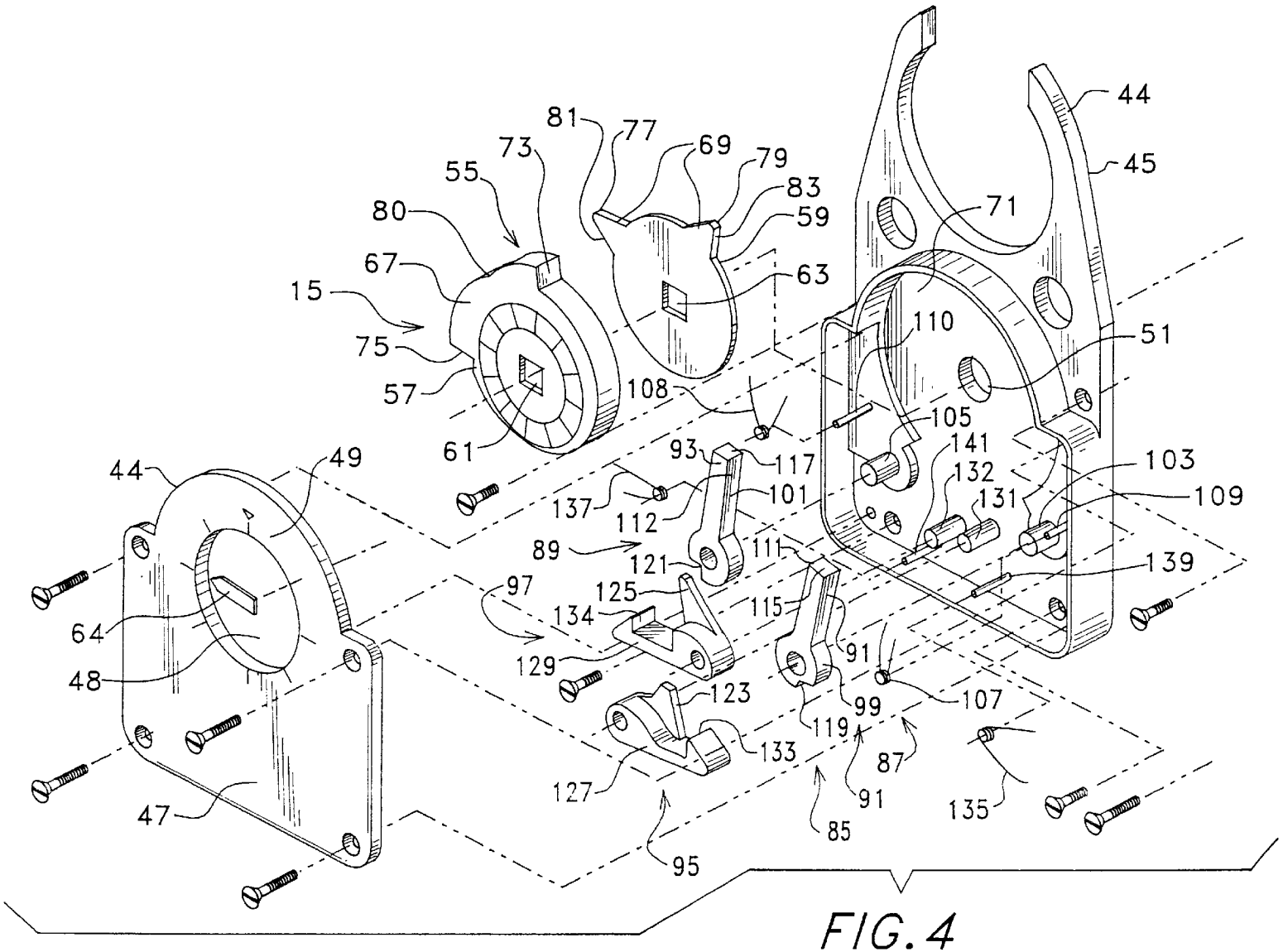
FIG. 4 is an exploded view of the apparatus illustrated in FIG. 3.

Apparatus 15 of this invention includes housing 44 having base 45 and cover 47 with access opening 48 therein having displacement degree gauge 49 arrayed thereabout at the outer surface of cover 47. As shown in FIGS. 3 and 4, base 45 includes mount opening 51 for receipt therethrough of shaft mount 53 (FIG. 2) from drive gear 33 of head 23, shaft mount 53 being, for example, directly driven, in concert with drive gear 33, by the ratchet gear. In this way, apparatus 15 is associable with the drive assembly.

It should be appreciated, however, that apparatus 15 could be mounted and associated with the drive assembly in any number of ways. For example, shaft mount 53 could be associated directly with the apparatus and applied at a receiving slot in drive gear 33. With appropriate modifications, the apparatus can be configured to be driven from any drive assembly source also linked to the socket (for example, idler gears 35 or 36), directly from the socket itself, or directly by the driver (such as ratchet drive 19) with a linkage provided from apparatus 15 to operate wrench head 23 of assembly 17. Moreover, while housing 44 is shown utilizing part of the housing of drive head 23 (at 45), the apparatus of this invention can be made totally independent of head 23 and readily removable therefrom (for example, by appropriately housing the apparatus and using snap-on fittings) so that the socket drive assembly can function alone and/or so that different apparatus of this invention adapted for differing degrees of rotational displacement control can be readily interchangeably applied to the drive assembly. The apparatus of this invention could be mounted integrally to the drive assembly, for example by adapting drive gear 33 to provide both drive assembly functions and the functions of the rotatable cam structure described below in a single integrated element. Finally, apparatus 15 could be provided with a gear or gear train arrangement driven from one of the assembly or socket thus allowing various apparatus size and drive characteristics modifications as would be apparent to one skilled in the art.

FIGS. 3 and 4 illustrate a first, and at present preferred, embodiment of apparatus 15 of this invention. This embodiment includes rotatable cam structure 55 with cam portions 57 and 59 (though the structure could be fully integrated) having central keyed mounting openings 61 and 63, respectively, for receipt of shaft mount 53. Pointer/grip 64 is secured at portion 57 so that selective manual cam position setting relative to displacement degree gauge 49 is accommodated through access opening 48 in cover 47 of housing 44. Structure 55, when assembled, presents a circumferentially projecting construct 65 thereat defined by cam face formations 67 and 69 at portions 57 and 59, respectively. Construct 65 is rotatable through rotation path 71 at housing base 45, with formations 67 and 69 thus axially differentiated to thereby rotate in substantially different planes through path 71.

As may be appreciated, rotation of cam structure 55 and socket 25 is made coincident by their common linkage with shaft 53. "Coincident rotation" as used in this application means that when the socket rotates so too does rotatable structure 55 of the apparatus of this invention (i.e., they rotate at the same time and cease rotation at the same time), though the socket and rotatable structure may not necessarily rotate in the same direction or at the same rate (since different embodiments could be conceived as discussed hereinabove wherein various gearing or linkage site arrangements would result in opposite rotation directions and/or differing rates of rotation).

Formation 67 of construct 65 includes spaced stop surfaces 73 and 75 oriented across rotation path 71 while formation 69 of construct 65 includes first and second trip nodes 77 and 79. Dual cam face nodes are illustrated for both formations 67 (while not pronounced, a node is adjacent to each of stop surfaces 73 and 75 and are separated by cam face indent 80) and 69, which may be of benefit, for example, to rotational stability and overall tool weight. Functionality of the embodiment of apparatus 15 illustrated in FIGS. 3 and 4 would be unchanged, however, if the formations had no nodes and were, instead, substantially monolithic structures (i.e., with respect to FIG. 4, as would be the case if constantly arced cam surfaces connected the outermost ends of the nodes defining the respective formations 67 and 69). In such a case, nodes 77 and 79 would be defined for purposes of this application as the opposite ends of formation 69 immediately adjacent to cam faces 81 and 83, respectively.

The rotation limiting mechanism 85 of this particular embodiment of apparatus 15 (see FIGS. 3 and 4) includes units 87 and 89 operatively interacting with different ones of surfaces 73 or 75 and nodes 77 or 79 of formations 67 and 69, respectively, of construct 65 of rotatable cam structure 55. However, as used in this application with respect to all embodiments, "rotation limiting mechanism" refers to any combination of a unit or units used as a means for limiting rotation of a cam structure (such as structure 55) in one or both directions of rotation, a "unit", as used herein, being understood to refer to either structures having plural related operational components or structures having primarily only a single, unitary operational component).

While bi-directional apparatus are illustrated in this application and are preferred for most applications used to limit cam (and, thus, socket) rotation in two directions, apparatus used to limit such rotation in only one direction of rotation employing this invention could be utilized. In such case, rotation limitation in the opposite direction of rotation can be affected by any means (mechanical, electrical, hydraulic, pneumatic, optical means or the like), or, for some applications, be omitted altogether. For example, in apparatus 15 of FIGS. 3 through 5, a unidirectional rotation control in accord with this invention would require only unit 87 and surface 73 of formation 67 and node 77 of formation 69 of construct 65 for clockwise angular displacement control exceeding about 360° (450° as illustrated) of cam structure 55 and thus a related socket where configured in a 1 to 1 turning ratio.

Each of the units 87 and 89 of this embodiment include similar elements mounted at base 45 of housing 44, including barrier portions 91 and 93, respectively, and actuating portions 95 and 97, respectively, spaced from portions 91 and 93 in down path directions therefrom (relative to forward—from 91 to 95 along path 71 in FIG. 3—and reversed—93 to 97 along path 71 in FIG. 3—directions of rotation). First and second biased pawls 99 and 101 having barrier portions 91 and 93 at one end thereof are mounted on pivots 103 and 105, respectively, through the other end thereof, pivots 103 and 105 held at housing base 45. These members are maintained with an established directional bias relative to rotation path 71 and cam structure 55 (toward the path in this embodiment) by springs 107 and 108 mounted over pins 109 and 110 at base 45. Return (or reset) contact surfaces 111 and 112 of pawls 99 and 101 (at barrier portions 91 and 93), respectively, are oriented inwardly (toward rotation path 71) for contact by formation 67 of cam portion 57 when in the path of rotation to move pawls 99 and 101 against their bias.

Barrier surfaces 115 and 117 of barrier portions 91 and 93, respectively, are located at one end of biased pawls 99 and 101, surfaces 111, 112, 115 and 117 each having a surface depth no greater than the depth of stop surfaces 73 and 75 of formation 67 of cam portion 57 ("depth" referring to dimensions along the z axis in FIGS. 3 and 4). Catch detents 119 and 121 are located at the opposite ends of pawls 99 and 101.

Lobes 123 and 125 and release arms 127 and 129 of actuating portions 95 and 97, respectively, together form unitary structures that are each pivotably mounted at a location between the lobe and arm of each structure on pivots 131 and 132 of base 45. Arms 127 and 129 include catch heads 133 and 134, respectively, engageable with catch detents 119 and 121, respectively, of pawls 91 and 93. Heads 133 and 134 have a surface depth no greater than the depth of detents 119 and 121, and lobes 123 and 125 are structured at actuating portions 95 and 97 to locate inwardly in housing 44 (toward base 45) from arms 127 and 129, with the contact surface depth of lobes 123 and 125 at rotation path 71 no greater than the contact surface depth of nodes 77 or 79. In this way, lobes 123/125 and barrier portions 91/93 will be located relative to rotation path 71 so that they are able to be contacted only by formations 69 or 67, respectively, rotating in their different planes of rotation.

Actuating portions 95 and 97 are biased (with lobes 123 and 125 urged toward rotation path 71 and heads 133 and 134 of release arms 127 and 129 urged toward detents 119 and 121 of biased pawls 99 and 101) by springs 135 and 137, respectively, mounted on pins 139 and 141 of base 45. As may be appreciated, the various dimensions and arrangements of the elements at base 45 assure that surfaces 111, 112, 115 and 117 at barrier portions 91 and 93 are selectively engageable only by stop surfaces 73 and 75 of cam portion 57 while lobes 123 and 125 are only contactable by nodes 77 and 79 of cam portion 59.

Figure 5A:
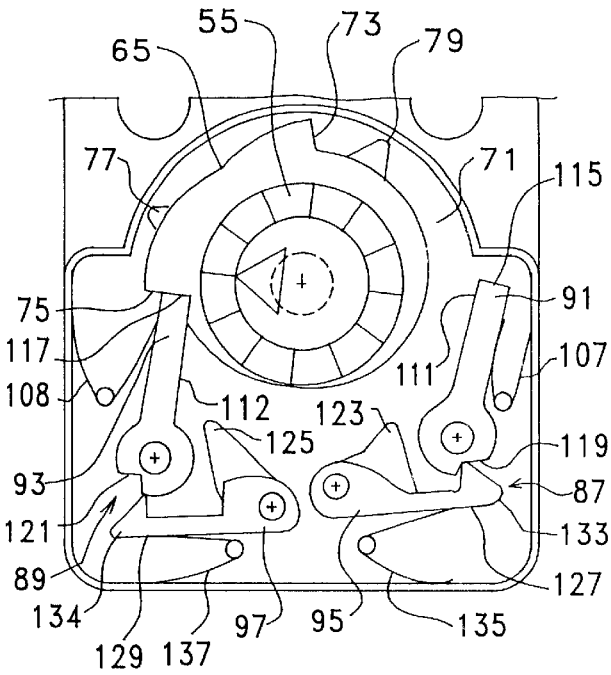
FIGS. 5A through 5O are partial top plan views of the apparatus of this invention configured as shown in FIG. 3 and illustrating operation of the apparatus.
Figure 5B:
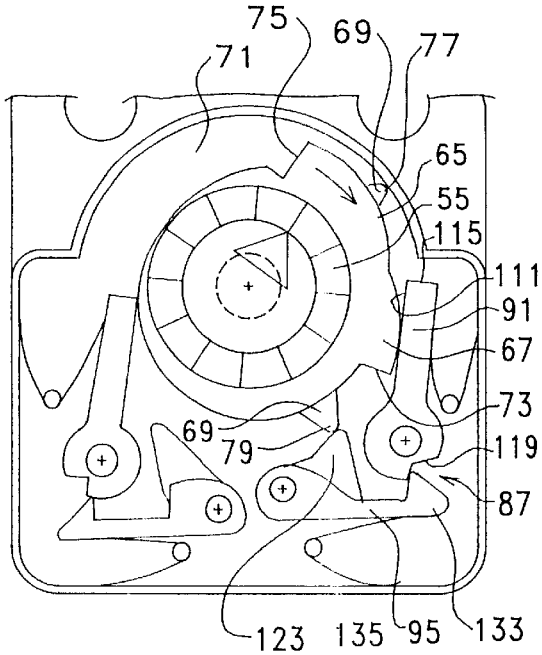
Figure 5C:
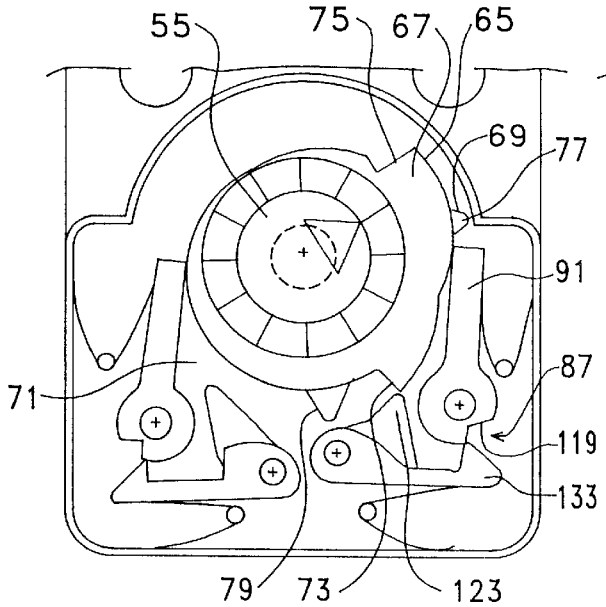
Figure 5D:
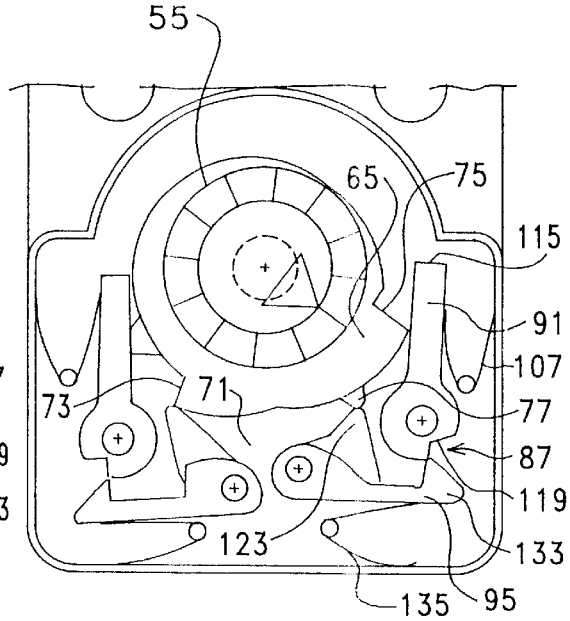
Figure 5E:
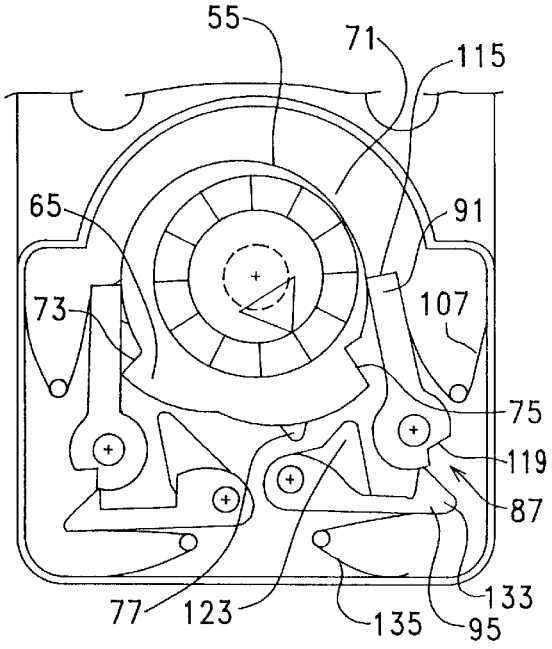
Figure 5F:
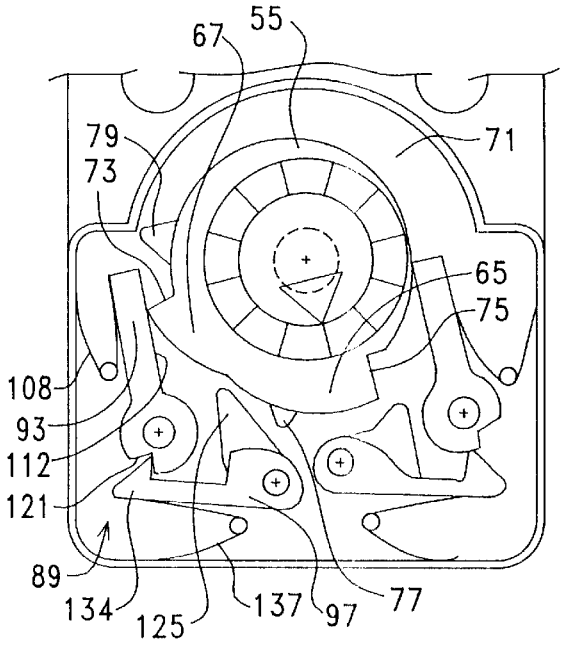
Figure 5G:
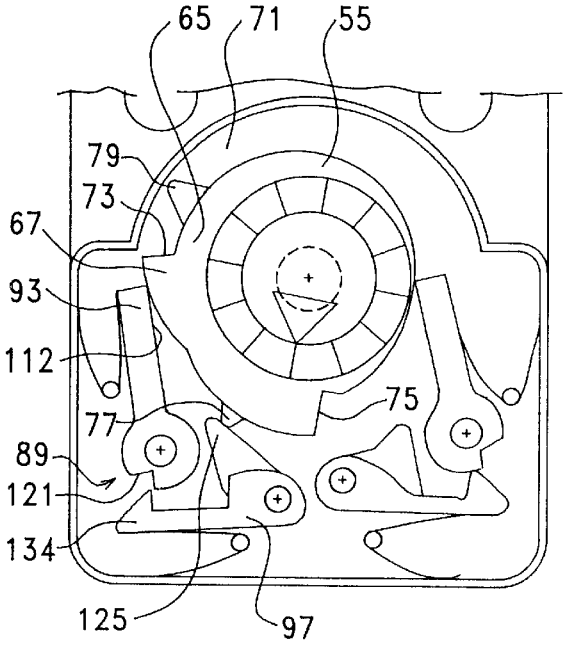
Figure 5H:
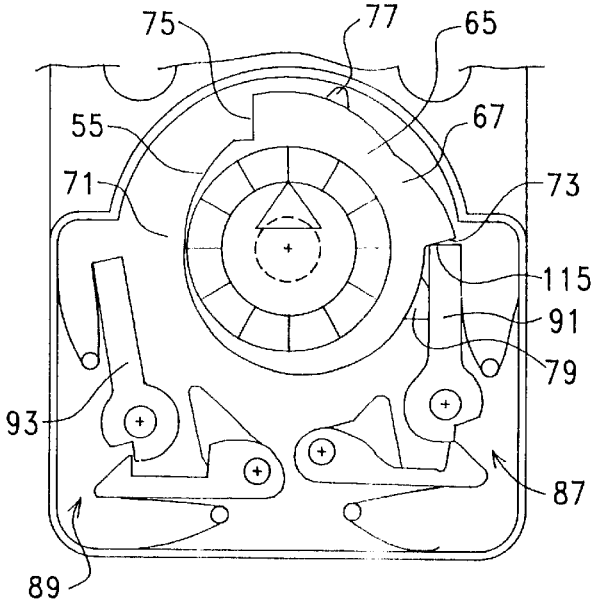
Figure 5I:
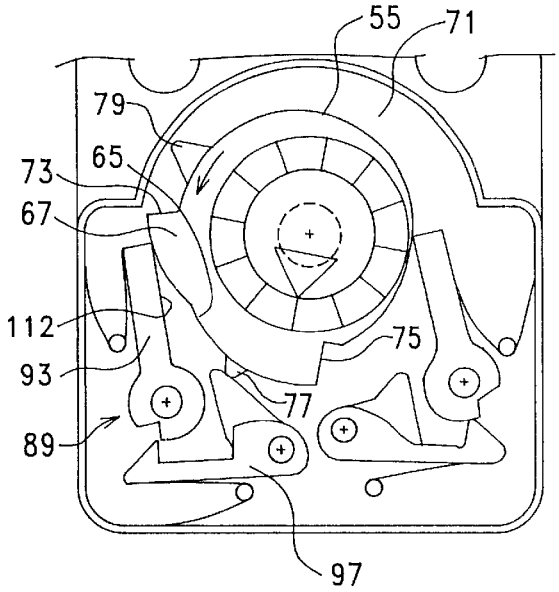
Figure 5J:
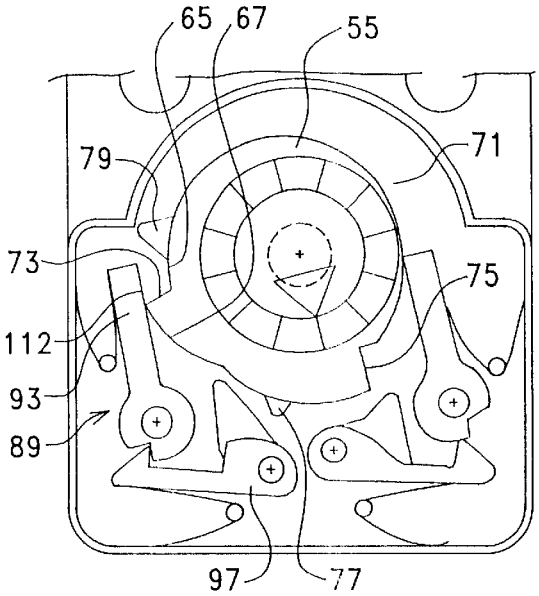
Figure 5K:
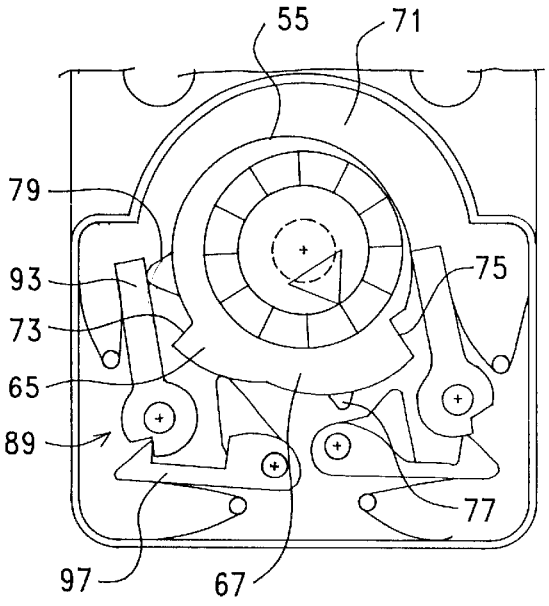
Figure 5L:
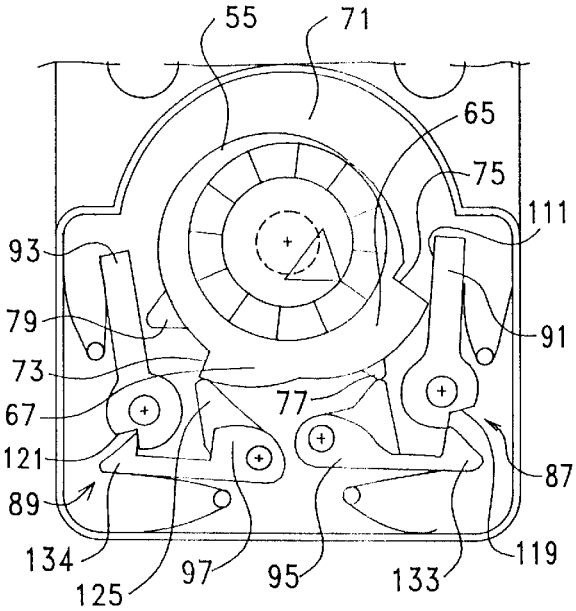
Figure 5M:
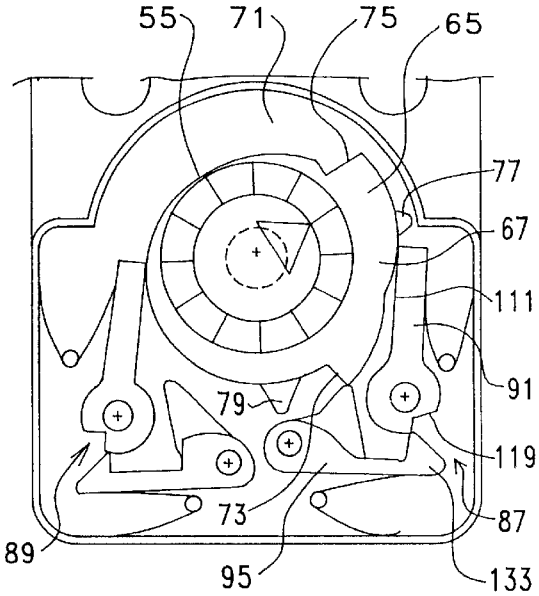
Figure 5N:
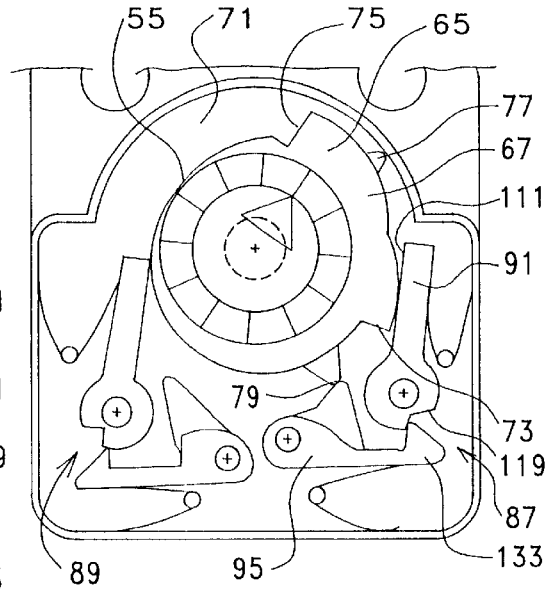
Figure 5O:
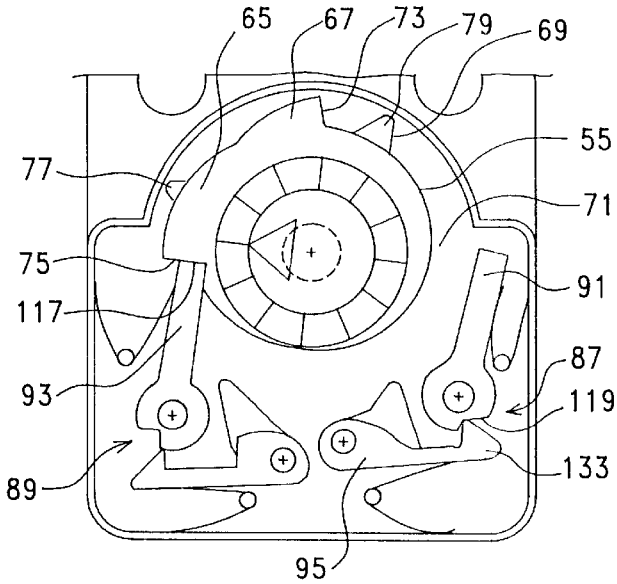

Turning to FIGS. 5A through 5O, a typical cycle of operation of the embodiment of apparatus 15 of this inventions shown in FIGS. 3 and 4 for limiting angular displacement (or rotation) of a slotted socket (25 of FIG. 1) to about 450° begins with stop surface 75 of construct 65 of cam structure 55 and barrier surface 117 of barrier portion 93 of unit 89 in contact before actuation of apparatus 15 by power application to socket drive assembly 17 (see FIG. 1). This position corresponds to a cam rotation start position which is indexed to the application position of slotted socket 25 in housing 37 when the slot in the socket is open to receipt of a fitting passing through the slot in the housing (see FIGS. 1 and 2).

When the various elements of apparatus 15 as shown in FIG. 5A are in the initial cam rotation start position, barrier portion 93 of unit 89 has been pivoted (by spring 108) so that barrier surface 117 is in rotation path 71. When barrier portion 93 is thus positioned, catch detent 121 and catch head 134 of actuating portion 97 of unit 89 are disengaged, actuating portion 97 held retracted (against its bias from spring 137) with lobe 125 slightly removed from rotation path 71 (although, as will be seen, this is not absolutely necessary). Barrier portion 91 of unit 87 is held out of rotation path 71 (against its bias from spring 107) by engagement of catch head 133 of actuating portion 95 of unit 87 with catch detent 119. Actuating portion 95 is thus positioned so that lobe 123 is at maximal extension into rotation path 71.

Presuming a 1 to 1 ratio of rotation of cam structure 55, drive gear 33 and socket 25 in the arrangement of FIGS. 1 and 2 (where rotation direction of all three elements is the same), one and one quarter rotations of cam structure 55 (from FIGS. 5A to 5H) in a forward (clockwise) direction corresponds to the same rotation of socket 25 and thus a fastener in engagement therewith (for example, being tightened by clockwise rotation). Rotation of cam structure 55 in the reverse (counterclockwise) direction returns slotted socket 25 to the application position and cam structure 55 to its rotation start position with all elements reset (after one and one quarter reverse rotations) for repetition of the cycle (FIGS. 5I to 5O).

As forward rotation begins (FIG. 5B), stop surface 73 of construct 65 passes barrier surface 115 of barrier portion 91 of unit 87. Node 79 of formation 69 of construct 65 (rotating in a distinct plane from stop surface 73 through rotation path 71) passes below barrier portion 91 without contact and thereafter contacts lobe 123 moving actuating portion 95 against its directional bias established by spring 135, but without effecting complete disengagement of catch head 133 from catch detent 119 (since formation 67 of construct 65 continues to bear on surface 111 of barrier portion 91).

Continued rotation of cam structure 55 moves formation 67 of construct 65 by (passing over) lobe 123, while node 77 of formation 69 passes below barrier portion 91 of unit 87, formation 67 continuing to hold barrier portion 91 out of rotation path 71 (FIG. 5C). After construct 65 has substantially passed barrier portion 91 of unit 87 (FIG. 5D), node 77 contacts lobe 123 moving it away from rotation path 71 and thus actuating portion 95 of unit 87 against its established bias, whereupon catch head 133 is moved out of engagement with catch detent 119. Barrier portion 91 is now free to respond to the bias established by spring 107, moving into rotation path 71 with barrier surface 115 oriented across path 71 (FIG. 5E). Catch head 133 and catch detent 119 remain disengaged while barrier portion 91 is thus pivoted, actuating portion 95 held retracted against its bias (from spring 135) with lobe 123 substantially removed from rotation path 71.

Continuing rotation brings formation 67 of construct 65 by lobe 125 (passing over it) and into contact with surface 112 of barrier portion 93 of unit 89 after node 79 passes beneath it (FIG. 5F). This initiates the setting of barrier portion 93 out of rotation path 71, barrier portion 93 thereafter held out of path 71 by engagement of head 134 with detent 121 responsive to spring 137 bias of actuating portion 97 of unit 89. While node 77 contacts lobe 125 as rotation continues, disengaging head 134 from detent 121, barrier portion 93 is not released thereby since formation 67 of construct 65 continues to bear on surface 112 of barrier portion 93 during such contact, the head and detent thus returning to engagement after passage of node 77 (FIGS. 5G and 5H).

Completing the 450° rotation of cam structure 55 brings node 77 beneath barrier portion 93, node 79 beneath barrier portion 91 and, ultimately (at FIG. 5H), stop surface 73 of formation 67 of construct 65 into contact with barrier surface 115 of barrier portion 91 of unit 87, halting rotation of cam structure 55 and, thereby, rotation of drive gear 33 and slotted socket 25 (see FIG. 2). To reset the various components to rotation start position of cam structure 55 and return socket 25 to its application position, or to initiate a driving force of a socket in the reverse direction of rotation, the drive force at socket drive assembly 17 is reversed. The operation of apparatus 15 during the one and one quarter reverse rotations illustrated in FIGS. 5I through 5O mirror the operation of apparatus 15 rotating in the forward direction as just described.

Briefly, as reverse rotation commences, construct 65 of cam structure 55 passes barrier portion 93 of unit 89 (FIGS. 5I and 5J) held in its retracted position relative to rotation path 71 by actuating portion 97 and/or the bearing of formation 67 on contact surface 112 at barrier portion 93. After substantially complete passage of construct 65 by barrier portion 93 (FIGS. 5K and 5L), and in particular after passage of formation 67, node 79 of construct 65 contacts lobe 125 of actuating portion 97 disengaging head 134 and detent 121 and thus releasing barrier portion 93 for biased movement into rotation path 71 with barrier surface 117 oriented across path 71. At this stage formation 67 comes into contact with surface 111 at barrier portion 91, initiating the setting of barrier portion 91 out of rotation path 71 (FIGS. 5L through 5N), thereafter secured thereat by the engagement of head 133 of actuating portion 95 of unit 87 with detent 119. Continued reverse rotation through the entire 450° halts cam structure 55 rotation (and thus rotation of the socket) when stop surface 75 of formation 67 contacts barrier surface 117 of barrier portion 93 of unit 89 (FIGS. 5O and 5A).

The degree of displacement affected by apparatus 15 is adjustable by manual manipulation of pointer/grip 64 (FIGS. 3 and 4) attached to cam structure 55, thereby effectively changing the rotation start position (i.e., advancing the cam structure) whether in the forward or reverse direction. Gauge 49 aids the user in determining the desired manual setting to achieve the desired degree of rotation.

While the apparatus illustrated in FIGS. 3 through 5 is configured for limiting rotation to one and one quarter turns, the apparatus can be differently configured to achieve different turn optimization (equal to or in excess of 360°) by changing the spacing along path 71 between barrier surfaces 115 and 117 of units 87 and 89, respectively, of rotation limiting mechanism 85, and/or the total degree of arc between stop surfaces 73 and 75 of formation 67 of construct 65 of cam structure 55.

Figure 6:
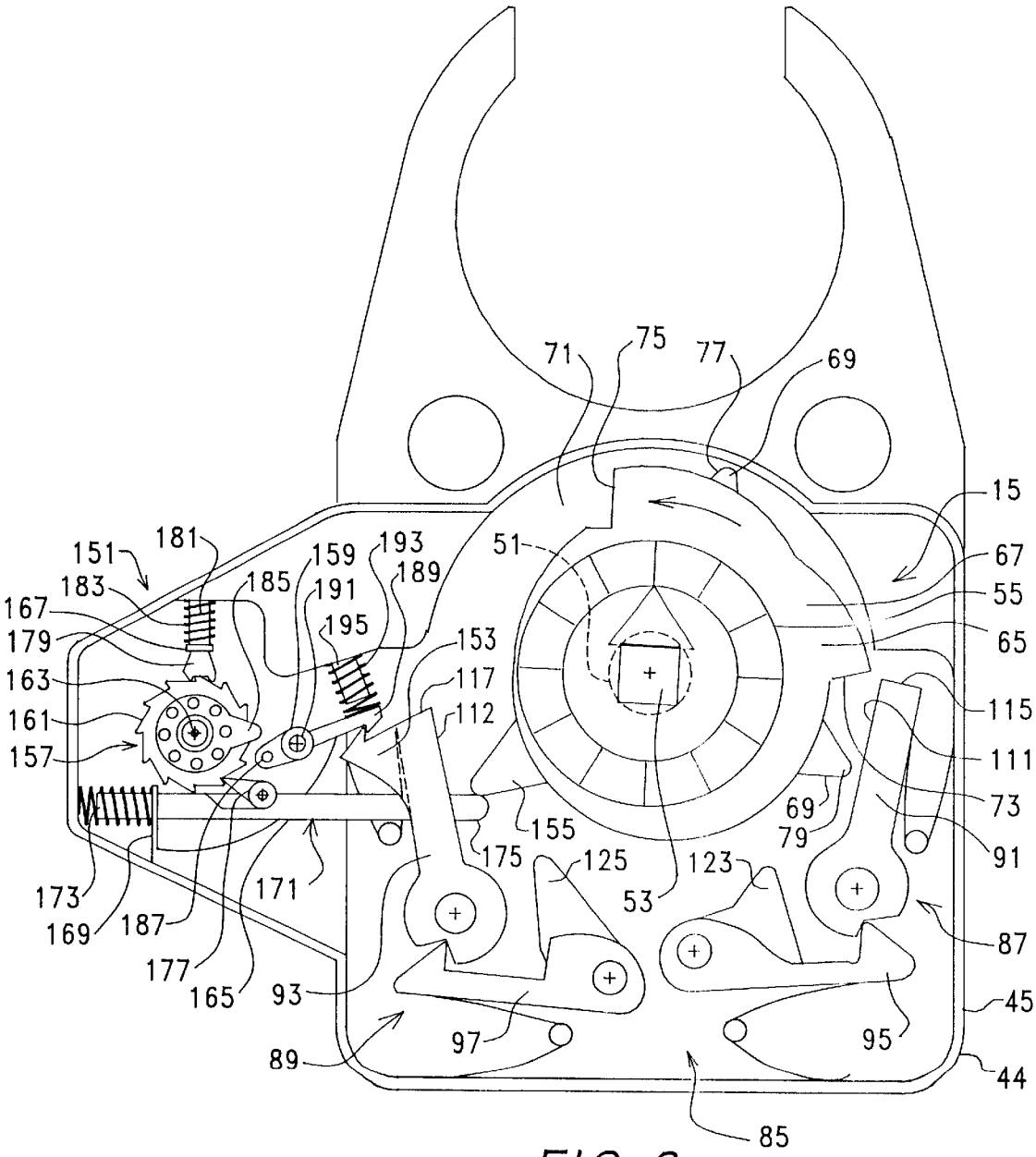
FIG. 6 is a top plan view of the embodiment of the apparatus of this invention shown in FIGS. 3 through 5 modified for inclusion of a mechanism allowing plural 360° rotations of the socket before actuation of the rotation limiting mechanism of the apparatus.

Turning now to FIG. 6, a modified embodiment of apparatus 15 is illustrated for inclusion of latching mechanism 151 maintained in modified base 45 of housing 44. Mechanism 151, together with the hereinafter described modifications, operates to allow selective lockout of a barrier portion 91/93 from rotation path 71 for a selected number of complete rotations of cam structure 55 before release of the barrier portion into rotation path 71 to halt rotation of cam structure 55 upon an additional 90° of rotation (in the illustrated embodiment) after barrier release. Thus, while normal operations can be maintained by proper setting of mechanism 151 (one and one quarter turns, for example), additional 360° turns of cam structure 55 (and thus the associated socket) in the direction of control can be selected by a user (up to 12 as shown in FIG. 6). While only one such mechanism 151 is illustrated in conjunction with barrier portion 93 (i.e., for lockout control during reverse cam rotation), such a mechanism can be associated with either or both barrier portions 91/93 for lockout control in either or both directions of cam structure rotation.

Apparatus 15 includes all of the elements heretofore described. However, to accommodate latching mechanism 151, barrier portion 93 includes catch attachment 153 fastened at the bottom of portion 93, and circumferentially projecting construct 65 includes yet a third formation (node 155). Node 155 is axially differentiated from formations 67 and 69 and thus rotates in a substantially different plane through rotation path 71 from the other two formations (in this case, below them when viewed as illustrated in FIG. 6). This in turn requires modification of the planar location of lobes 123 and 125 and barrier surfaces 111, 112, 115 and 117 so that node 155 will not contact them and so that they will be positioned for contact by formations 67 and 69 of construct 65 for normal operations thereof as heretofore described.

Latching mechanism 151 includes counting unit 157 and release unit 159. Counting unit 157 is comprised of ratchet wheel 161 rotatably mounted on axle 163 held at housing base 45, ratchet arm 165 and stabilizing arm 167. Ratchet arm 165 is located and stabilized by mounting bars 169 and 171 of housing base 45, and is biased (toward unit 89) by spring 173 so that end 175 is normally established in rotation path 71 for contact (and thus movement against its bias) by node 155. Dog 177 is pivotably connected with ratchet arm 165 so that rotation of ratchet wheel 161 in a clockwise direction is accommodated, the ratchet teeth pivoting dog 177 out of the way, but counterclockwise rotation is resisted. Stabilizing arm 167 includes ratchet head 179 on shaft 181 mounted with housing base 45. Spring 183 urges firm contact of head 179 at the teeth of wheel 161 to resist counterclockwise rotation of the wheel while yielding for clockwise rotation thereof.

Ratchet wheel 161 includes cam lobe 185 positioned to engage only end 187 of release unit 159. Release unit 159 includes catch head 189 at an opposite end of unit 159 from end 187 and releasably engageable with catch attachment 153 at barrier portion 93. Unit 159 is pivotably mounted at housing base 45 on pivot 191 between end 187 and head 189. Biasing spring 193, for urging head 189 toward engagement with attachment 153, is mounted on stop post 195 held at housing base 45.

Ratchet wheel 161 is preferably provided with a manual grip and pointer at the top surface thereof, access to which would be accommodated by an opening in modified housing cover 47 having a rotation selection gauge arrayed therearound (not shown). For as long as barrier portion 93 is held out of rotation path 71 by latching mechanism 151, rotation of cam structure 55 in the counterclockwise direction remains unimpeded (while barrier portion 91 will be periodically released by contact of lobe 123 by node 79, this movement will not impede rotation in the counterclockwise direction since barrier portion 91 will continually be urged back out of rotation path 71 during rotation in this direction).

Each time that node 155 contacts end 175 of ratchet arm 165 (once each rotation), arm 165 is moved against its bias and dog 177 urges ratchet wheel 161 forward until dog 177 is in position to be engaged at the next ratchet tooth. This will continue until cam lobe 185 is rotated into contact with end 187 of release unit 159, whereupon catch head 189 is pivoted out of engagement with catch attachment 153 thus releasing barrier portion 93 for biased movement into rotation path 71. FIG. 6 illustrates this condition just prior to release of barrier portion 93. As can be seen, after release, engagement of stop surface 75 and barrier surface 117 will occur after about an additional 90° of cam structure 55 rotation.

If standard one and one quarter cam structure rotation is desired (i.e., beginning with surfaces 73 and 115 in contact in FIG. 6), ratchet wheel 161 should be set for one turn (corresponding to dog 177 location at the ratchet wheel teeth as illustrated in FIG. 6). As may be appreciated, each ratchet wheel tooth thus equates to a different rotational setting. Setting may be accomplished manually or by running the apparatus under power, but not engaged with a fastener, to the desired rotational setting.

A second embodiment of apparatus 15 of this invention is schematically illustrated in FIGS. 7A through 7D wherein components similar to components in the prior embodiment of the apparatus will share the same identifying indicia. This embodiment of the apparatus is arrayed in housing 44 and is associable with assembly 17 and accessible to a user using the same means as heretofore described (for example, being linked with drive gear 33 in FIG. 2 by shaft mount 53).

As before, a rotatable cam structure 55 (a unitary formation in this embodiment) is mounted at shaft mount 53 maintained through housing base 45, and includes circumferentially projecting construct 65 rotatable through rotation path 71. Construct 65 is much simplified from that previously disclosed, comprising a unitary cam face formation 201 having spaced stop surfaces 73 and 75 oriented across rotation path 71 thereat.

Rotation limiting mechanism 85 of this second embodiment of apparatus 15 includes units 87 and 89 operatively interacting with surfaces 73 and 75, respectively. Units 87 and 89 in this embodiment are defined by pivotable levers 203 and 205 having barrier portions 91 and 93, respectively, at one leg thereof and actuating portions 95 and 97, respectively, at the other leg thereof, pivots 207 and 209, respectively, mounted at housing base 45 and located between the legs of levers 203 and 205. Barrier portions 91 and 93 include barrier surfaces 115 and 117, respectively, at the ends thereof and return contact surfaces 111 and 112, respectively oriented inwardly (toward rotation path 71) for selective contact by construct 65 as heretofore described. Actuating portions 95 and 97 include lobes 123 and 125, respectively, at the ends thereof.

Cooperative retention mechanisms 207 are located with elements at housing base 45 and with cooperating elements at the bottom surfaces (i.e., facing housing base 45) of actuating portion 95 and 97 (though they could as well be located at barrier portions 91 and 93). Mechanisms 207 are provided to establish location of levers 203 and 205 at their two operative positions (with either a barrier portion 91/93 or lobe 123/125 of levers 203/205 in rotation path 71). These cooperative mechanisms can be any of the known position retention devices used in such applications (such as ball and detent arrangements, bar and slot arrangements or other friction retainers).

FIGS. 7A through 7D illustrate operation of this embodiment of apparatus 15 during the portion of the operational cycle including counterclockwise cam structure 55 rotation (similar to FIGS. 5H through 5O). Again, the illustrated embodiment is structured for limiting rotation to 450° of angular displacement of cam structure 55 in either direction and thus of a socket with which apparatus 15 is associated (again, presuming for purposes of illustration, a 1 to 1 ratio of rotation of cam structure 55, drive gear 33 and socket 25 in the arrangement of FIGS. 1 and 2).

Figure 7A:
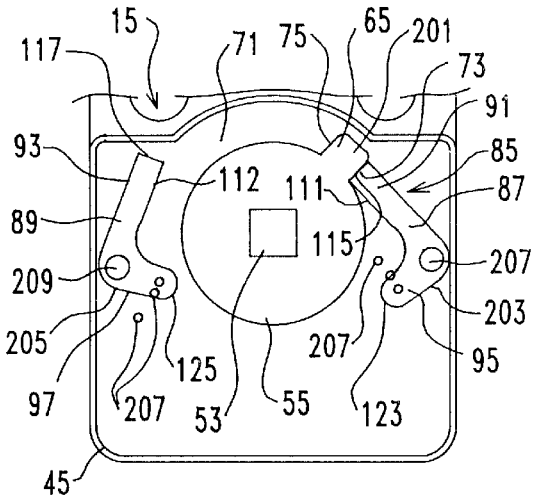
FIGS. 7A through 7D are schematic partial top plan views of a second embodiment of the apparatus of this invention.
Figure 7B:
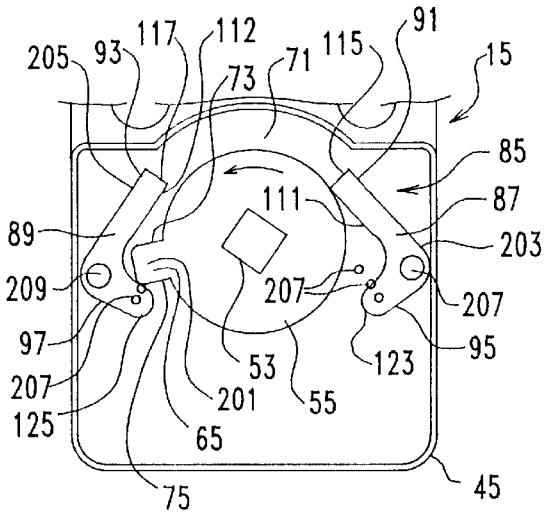

As reverse cam structure 55 rotation begins (starting with stop surface 73 of construct 65 in contact with barrier surface 115 of barrier portion 91 of unit 87—FIG. 7A), construct 65 of cam structure 55 passes barrier portion 93 of unit 89 and contacts lobe 125 of actuating portion 97 of unit 89 (FIG. 7B). This contact dislodges lever 205 from its then operative position as retained by mechanism 207 associated therewith and pivots lever 205 to a new operative position with barrier portion 93 located in rotation path 71 so that barrier surface 117 is oriented across the path of rotation and with lobe 125 of actuating portion 97 moved away from rotation path 71. Lever 205 is retained at its new operative position by the associated mechanism 207.

Figure 7C:
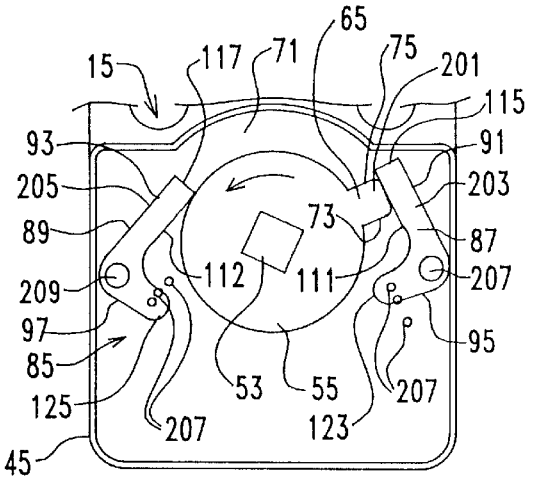
Figure 7D:
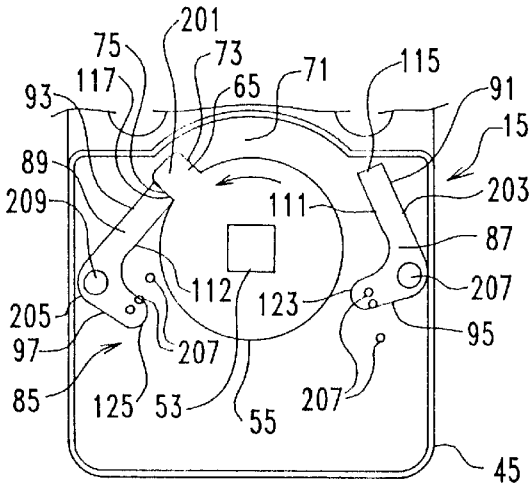

As rotation continues, construct 65 contacts return surface 111 of barrier portion 91 of unit 87, dislodging lever 203 from its then operative position as retained by mechanism 207 associated therewith and pivoting lever 203 to a new operative position with barrier portion 91 located out of rotation path 71 and with lobe 123 of actuating portion 95 moved into rotation path 71 (FIG. 7C). Lever 203 is retained at its new operative position by its associated mechanism 207. Continued reverse rotation halts cam structure 55 rotation when stop surface 75 of construct 65 contacts barrier surface 117 of barrier portion 93 (FIG. 7D).

At this position (i.e., the cam rotation start position) a slotted socket 25 will be located at its application position with its slot open to receipt of a fitting passed through the slot in housing 37 of wrench head 23 of assembly 17 (see FIGS. 1 and 2). Forward rotation from this position (i.e., proceeding from FIGS. 7D to 7A) effects one and one quarter forward rotations of cam structure 55 (and so the related socket), mirroring the operation of this embodiment of apparatus 15 as just described.

As with the prior embodiment of apparatus 15, degree of displacement effected by this embodiment of apparatus 15 may be made adjustable by a user with provision of a manually manipulable pointer/grip and related displacement gauge as heretofore described. Likewise, while the apparatus illustrated in FIGS. 7A through 7D is configured for limiting rotation to one and one quarter turns, the apparatus can be differently configured to achieve different turn optimization by changing the spacing along path 71 between barrier surfaces 115 and 117 of units 87 and 89, respectively, and/or the total degree of arc between stop surfaces 73 and 75 of cam face formation 201 of cam structure 55 (the latter involving increasing the size and/or configuration of levers 203 and 205). Provision for multiple 360° rotations can be conceived in this embodiment utilizing a latching mechanism and modifications as heretofore described but adapted for use with this embodiment.

Moreover, features of the two embodiments heretofore described can be combined to provide still different embodiments. For example, deletion of retention mechanisms 207 and provision of means to establish directional bias of barrier portions 91 and 93 of levers 203 and 205 out of the rotation path 71 might be utilized in combination with capture and release units positioned between the legs of the levers. The capture and release units would capture barrier portions 91/93 when moved against their bias by contact between construct 65 and a related lobe 123/125, and release them for movement with their established bias when a portion of the capture and release units in path 71 is contacted by construct 65.

Figure 8A:
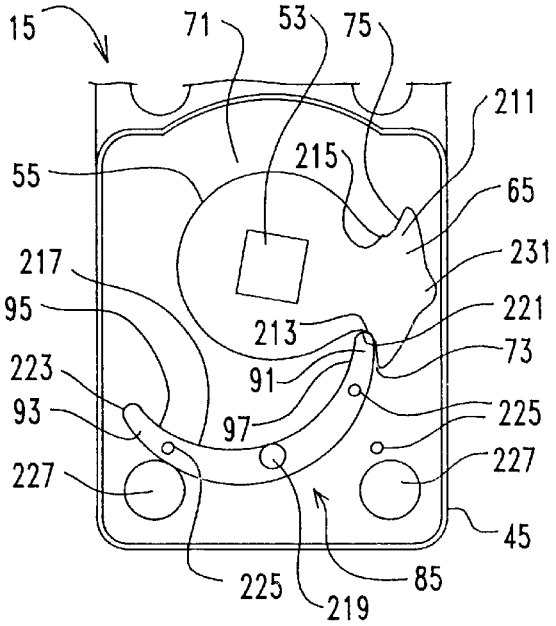
FIGS. 8A through 8C are schematic partial top plan views of a third embodiment of the apparatus of this invention.
Figure 8B:
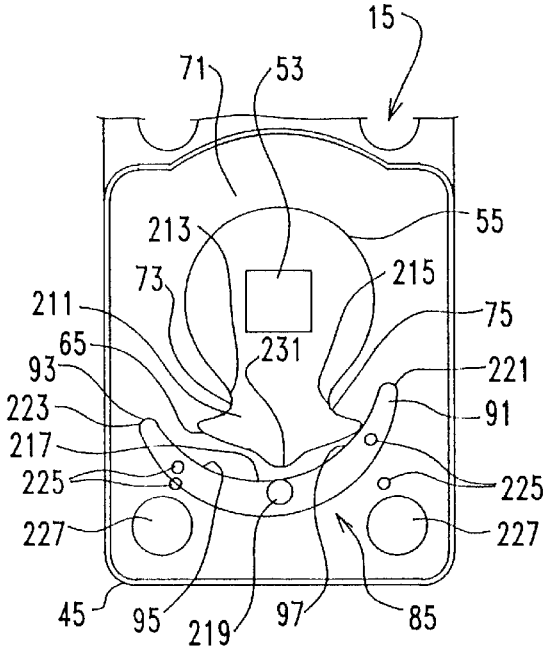
Figure 8C:
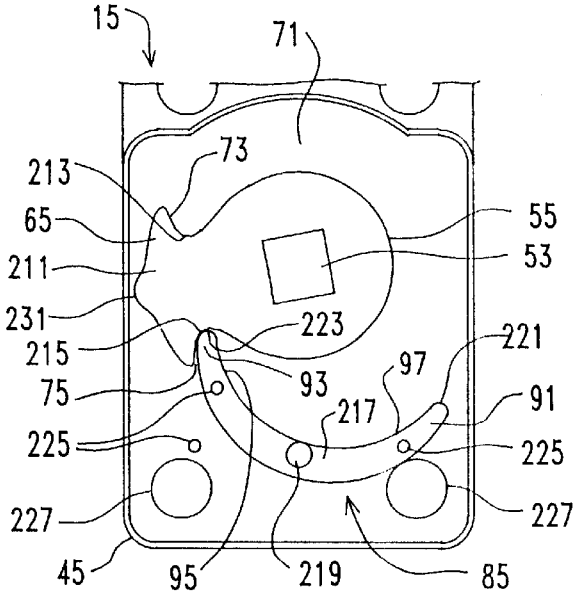

A third embodiment of apparatus 15 of this invention is schematically illustrated in FIGS. 8A through 8C wherein components similar to components in the prior embodiments of the apparatus will share the same identifying indicia. As before, this third embodiment of the apparatus is arrayed in housing 44, is associable with assembly 17 and is accessible to a user in the same ways as heretofore described with respect to the first and second embodiments of apparatus 15.

Again, a rotatable cam structure 55 (as in the second embodiment, a unitary formation) is mounted at shaft mount 53 maintained through housing base 45 (and which is, for example, linked with drive gear 33 as shown in FIG. 2). Cam structure 55 includes circumferentially projecting construct 65 rotatable through rotation path 71. Construct 65 of this embodiment is comprised of a unitary cam face formation 211 having spaced stop surfaces 73 and 75 which include arcuate segments 213 and 215, respectively, oriented across rotation path 71.

Rotation limiting mechanism 85 of this second embodiment of apparatus 15 includes a single unit 217 (combining the functions of units 87 and 89 as heretofore described) operatively interacting with segments 213 and 215 of surfaces 73 and 75, respectively. Unit 217 in this embodiment has barrier portions 91 and 93 at opposite ends thereof, with actuating portions 95 and 97 defined at opposite ends of the inner surface (nearest rotation path 71) of unit 217. Thus, barrier portion 91 and actuating portion 97 are adjacent to one another, as are barrier portion 93 and actuating portion 95. Pivot 219 is mounted at housing base 45 and located through unit 217 between barrier portions 91/actuating portion 97 and barrier portion 93/actuating portion 95.

Barrier portions 91 and 93 include arcuate barrier surfaces 221 and 223 (corresponding to surfaces 115 and 117 as heretofore described), respectively, at the ends thereof and shaped to be received at arcuate segments 213 and 215, respectively, of stop surfaces 73 and 75. The functions of return contact surfaces 111 and 112 and lobes 125 and 123 of the first and second embodiments of apparatus 15 are fulfilled by the surfaces of unit 217 defining actuating portions 97 and 95, respectively, and thus share identity therewith.

Cooperative retention mechanisms 225 are located with elements at housing base 45 and with cooperating elements at the bottom surface (i.e., facing housing base 45) of the opposite ends of unit 217. Mechanisms 225 are provided, in conjunction with stop posts 227 mounted at housing base 45, to establish location of unit 217 at its two operative positions (with either a barrier portion 91/actuating portion 97 or barrier portion 93/actuating portion 95 in rotation path 71). As discussed above, these cooperative mechanisms can be any of the known position retention devices used in such applications.

FIGS. 8A through 8C illustrate operation of this embodiment of apparatus 15 during the portion of the operational cycle including counterclockwise cam structure 55 rotation (similar to FIGS. 5H through 5O or 7A through 7D). This embodiment is structured for limiting rotation to 450° of angular displacement of cam structure 55 in either direction and thus of an associated socket (as before, presuming a 1 to 1 ratio of rotation of cam structure 55, drive gear 33 and socket 25 in the arrangement of FIGS. 1 and 2).

As reverse cam structure 55 rotation begins (starting with segment 213 of stop surface 73 of construct 65 in contact with barrier surface 221 of barrier portion 91 of unit 217—FIG. 8A), construct 65 of cam structure 55 passes barrier portion 93 of unit 217 (FIG. 8B). As can be seen, continuing rotation will brings the projecting end of stop surface 75 and node 231 of formation 211 of construct 65 into contact with the surface of unit 217 defining actuating portion 97 (and equivalent to lobe 125/contact surface 111), dislodging unit 217 from its then operative position as retained by mechanisms 225 and pivoting unit 217 during passage of construct 65 to a new operative position with barrier portion 93/actuating portion 95 located in rotation path 71 so that barrier surface 223 is oriented across the path of rotation and with barrier portion 91/actuating portion 97 moved away from rotation path 71. Unit 217 is retained at its new operative position by mechanisms 225. Continued reverse rotation halts cam structure 55 rotation when segment 215 of stop surface 75 of construct 65 contacts barrier surface 223 of barrier portion 93 (FIG. 8C).

At this position (i.e., the cam rotation start position) a slotted socket 25 will be located at its application position as heretofore described. Forward rotation from this position (i.e., proceeding from FIGS. 8C to 8A) effects one and one quarter forward rotations of cam structure 55 (and so the related socket), mirroring the operation of this embodiment of apparatus 15 as just described.

As with the prior embodiments of apparatus 15, a manually manipulable pointer/grip and related displacement gauge as heretofore described may be provided. Likewise, the apparatus can be differently configured to achieve different turn optimization by changing the spacing along path 71 between barrier surfaces 221 and 223 of units 217 and/or the total degree of arc between segments 213 and 215 of stop surfaces 73 and 75, respectively, of cam face formation 211 of cam structure 55. Provision for multiple 360° rotations can be conceived in this embodiment utilizing a latching mechanism and modifications as heretofore described but adapted for use with this embodiment.

As may be appreciated from the foregoing, multiple embodiments of apparatus and methods for precision control of extent of rotation of a socket are shown and described, the apparatus directly controlling angular displacement independent of particular operational torque application requirements in applications where extent of socket rotation desired is about equal to or exceeds 360°. The apparatus is adaptable for use with a variety of drive head sizes an/or configurations and driver applications including fluid or electrical drives, and is not susceptible to socket "coasting" beyond the desired angular displacement and thus torque application. The apparatus functions as intended without regard to the particular size, type, or exhibited rotational resistance characteristics of a fastener being manipulated by the socket. Utilizing the foregoing, other combinations of elements and options as taught herein in the various embodiments of this invention may come to the mind of a skilled artisan, and these combinations are also intended to come within scope of the claims as hereinafter presented.

What is claimed is:

1. An apparatus for limiting angular displacement of a socket, the socket held in an assembly including a drive for effecting rotation of the socket, said apparatus comprising:

a rotatable structure including a circumferentially projecting construct rotatable through a path of rotation, said rotatable structure associable with the assembly so that rotation of said rotatable structure and rotation of the socket are coincident; and a unit maintained adjacent to said rotatable structure, said unit having a first portion movable into and out of said path of rotation and a second portion at said path of rotation spaced from said first portion in a down-path direction corresponding to a first direction of rotation of said rotatable structure, said first portion interacting with said construct of said rotatable structure to halt rotation of said rotatable structure in said first direction of rotation when said first portion is in said path of rotation, said second portion of said unit contactable by said construct of said rotatable structure moving in said first direction of rotation to effect movement of said first portion relative to said path of rotation.

2. The apparatus of claim 1 wherein said construct of said rotatable structure includes first and second circumferentially projecting formations, said first and second formations axially differentiated so that said formations rotate in substantially different planes through said path of rotation and interact with different ones of said first and second portions of said unit.

3. The apparatus of claim 2 wherein said unit includes a biased member maintained adjacent to said rotatable structure with an established directional bias, said biased member having said first portion thereat and a surface contactable by said first formation of said rotatable structure moving in a reverse direction of rotation when said biased member is in said path of rotation causing movement of said biased member against said bias relative to said path of rotation, said first portion interacting with said first formation of said construct of said rotatable structure to halt rotation of said rotatable structure in said first direction of rotation when said first portion is in said path of rotation.

4. The apparatus of claim 2 wherein said second portion of said unit includes a lobe positioned for contact by said second formation during rotation of said rotatable structure and a release positioned to capture and hold said first portion of said unit and to release said first portion responsive to contact of said lobe by said second formation allowing movement of said first portion into said path of rotation of said construct of said rotatable structure.

5. The apparatus of claim 4 wherein said second portion of said unit includes a pivot between said lobe and said release and biasing means urging said lobe and said release so that said lobe is biased toward said path of rotation and said release is biased toward contact with said first portion of said unit.

6. The apparatus of claim 1 wherein said circumferentially projecting construct of said rotatable structure includes a stop surface oriented across said path of rotation, wherein said unit includes a pivotable member mounted on a pivot, said first portion located at one end of said pivotable member and having a barrier surface thereat, said second portion at another end of said pivotable member opposite said pivot from said first portion and including a lobe contactable by said construct of said rotatable structure to effect movement of said barrier surface of said first portion into position at said path of rotation for contact by said stop surface of said circumferentially projecting construct of said rotatable structure.

7. The apparatus of claim 1 wherein the assembly drive includes a drive head attachable to a driver, said apparatus further comprising associating means for releasably associating said rotatable structure and the drive head and a housing holding said unit and having an access defined thereat accommodating said associating means, said housing releasably connectable with the assembly.

8. The apparatus of claim 1 including manually manipulable angular displacement selection means connected with said rotatable structure for selection of degree of angular displacement of the socket by manual selection of a start position of said rotatable structure.

9. The apparatus of claim 1 wherein the socket is a slotted socket and wherein said rotatable structure is oriented with a rotation start position indexed to a selected position of the slotted socket, said apparatus further comprising means for assuring correct repositioning of said rotatable structure at said rotation start position after rotation thereof in said first direction is halted by said first portion of said unit.

10. The apparatus of claim 9 wherein a circumferential dimension of said construct of said rotatable structure is selected so that, in cooperation with selected location of said rotation start position and selected location of said first portion of said unit when in said path of rotation, unimpeded rotation of said rotatable structure, and thus angular displacement of said socket, is accommodated exceeding about 360° and is limited to about 450°.

11. An apparatus for limiting angular displacement of a slotted socket to a selected extent in excess of about 360°, the slotted socket held in an assembly including a drive for effecting rotation of the socket, said apparatus comprising:

a rotatable structure including a circumferentially projecting construct with first and second spaced surfaces and rotatable through a path of rotation, said rotatable structure having a mount associable with the assembly so that rotation of said rotatable structure in either of forward or reversed directions is coincident with socket rotation in either of clockwise or counterclockwise directions; and rotation limiting means for limiting rotation of said rotatable structure to a selected extent in excess of about 360° in either of said forward or reversed directions of rotation, said rotation limiting means including first and second barrier portions and first and second actuating portions, said first barrier portion movable into and out of said path of rotation and said first actuating portion at said path of rotation spaced from said first barrier portion in a down-path direction corresponding to said forward direction of rotation of said rotatable structure, said first barrier portion interacting with said first surface of said construct of said rotatable structure to halt rotation of said rotatable structure in said forward direction of rotation when said first barrier portion is in said path of rotation, said first actuating portion contactable by said construct of said rotatable structure moving in said forward direction of rotation to effect movement of said first barrier portion into said path of rotation, said second barrier portion movable into and out of said path of rotation and said second actuating portion at said path of rotation spaced from said second barrier portion in a downpath direction corresponding to said reversed direction of rotation of said rotatable structure, said second barrier portion interacting with said second surface of said construct of said rotatable structure to halt rotation of said rotatable structure in said reversed direction of rotation when said second barrier portion is in said path of rotation, said second actuating portion contactable by said construct of said rotatable structure moving in said reversed direction of rotation to effect movement of said second barrier portion into said path of rotation.

12. The apparatus of claim 11 wherein said rotation limiting means includes first and second units maintained adjacent to said rotatable structure, said first unit having said first barrier portion and said first actuating portion thereat, and said second unit having said second barrier portion and said second actuating portion thereat.

13. The apparatus of claim 12 wherein each of said units of said rotation limiting means includes a pivot between said barrier portion and said actuating portion thereof and a contact surface at said barrier portion thereof, said contact surface of said first unit contactable by said circumferentially projecting construct of said rotatable structure rotating in said reversed direction of rotation to effect movement of said first barrier portion out of said path of rotation and movement of said first actuating portion into said path of rotation, and said contact surface of said second unit contactable by said circumferentially projecting construct of said rotatable structure rotating in said forward direction of rotation to effect movement of said second barrier portion out of said path of rotation and movement of said second actuating portion into said path of rotation.

14. The apparatus of claim 11 wherein:

said rotatable structure is a cam and said circumferentially projecting construct includes first and second circumferentially projecting cam face formations, said first formation having said first and second spaced surfaces thereat, said first and second formations axially differentiated so that said first formation rotates in a substantially different plane from said second formation through said path of rotation;

said rotation limiting means includes a first biased member having said first barrier portion thereat and a second biased member having said second barrier portion thereat, said first biased member mounted adjacent to said cam with an established directional bias and contactable by said first formation of said circumferentially projecting construct of said cam moving in said reversed direction of rotation when said first barrier portion of said first biased member is in said path of rotation causing movement of said first biased member against said established directional bias of said first biased member;

said second biased member mounted adjacent to said cam with an established directional bias and contactable by said first formation of said circumferentially projecting construct of said cam moving in said forward direction of rotation when said second barrier portion of said second biased member is in said path of rotation causing movement of said second biased member against said established directional bias of said second biased member;

said first actuating portion mounted adjacent to said cam and said first biased member for selectively capturing and holding said first biased member against said established directional bias thereof and releasing said first biased member responsive to contact with said second formation of said circumferentially projecting construct of said cam moving in said forward direction of rotation allowing biased movement of said first biased member so that said first barrier portion moves into said path of rotation; and said second actuating portion mounted adjacent to said cam and said second biased member for selectively capturing and holding said second biased member against said established directional bias thereof and releasing said second biased member responsive to contact with said second formation of said circumferentially projecting construct of said cam moving in said reversed direction of rotation allowing biased movement of said second biased member so that said second barrier portion moves into said path of rotation.

15. The apparatus of claim 11 wherein said first and second actuating portions of said rotation limiting means each include a lobe positioned for contact by said circumferentially projecting construct of said rotatable structure and a release positioned to capture and hold respective ones of said first and second barrier portions of said rotation limiting means and to release said respective ones of said first and second barrier portions responsive to contact of said lobes by said circumferentially projecting construct, each of said actuating portions of said rotation limiting means having a pivot between said lobe and said release thereof and biasing means urging said lobe and said release so that said lobes are biased toward said path of rotation and said releases are biased toward contact with said respective ones of said first and second barrier portions of said rotation limiting means.

16. The apparatus of claim 11 wherein the drive of the assembly includes a drive gear directly or indirectly driving the socket, said mount of said rotatable structure including a shaft connectable between said rotatable structure and the drive gear.

17. The apparatus of claim 11 further comprising a base having said rotatable structure and said unit mounted thereon, said base releasable attachable to the assembly.

18. The apparatus of claim 17 further comprising a manually manipulable angular displacement degree selector connected with said rotatable structure and a cover connectable with said base and having an opening therethrough for accessing said selector, said cover having a displacement gauging array at said opening.

19. The apparatus of claim 11 wherein said first barrier portion and second actuating portion are adjacent to one another and second barrier portion and first actuating portion are adjacent to one another, said rotation limiting means including a pivot located between said first and second actuating portions.

20. The apparatus of claim 11 further comprising latching means for releasably latching at least one of said barrier portions of said rotation limiting means against movement into said path of rotation for a selected number of complete rotations of said rotatable structure, said latching means including a counting mechanism contactable by said circumferentially projecting construct of said rotatable structure for tracking said selected number of complete rotations of said rotatable structure and a release mechanism actuatable by said counting mechanism to release said at least one of said barrier portions after completion of said selected number of complete rotations of said rotatable structure.

21. A method for controlling rotation of a socket to a selected extent equal to or in excess of about 360° comprising the steps of:

effecting coincident rotation of the socket and a cam having a circumferentially projecting construct including a surface oriented across a path of rotation;

forwarding rotation of said circumferentially projecting construct of said cam past a barrier and into contact with a lobe to effect movement of said barrier into said path of rotation after passage of said surface of said circumferentially projecting construct of said cam;

continuing cam rotation until contact between said surface of said circumferentially projecting construct and said barrier halts rotation of said cam and thereby rotation of the socket; and reversing cam rotation to thereby effect movement of said barrier out of said path of rotation.

22. The method of claim 21 further comprising the step of biasing said barrier toward said path of rotation, contact with said lobe by said circumferentially projecting construct of said cam releasing said barrier for biased movement.

23. The method of claim 21 further comprising the steps of providing a second surface at said circumferentially projecting construct of said cam oriented across said path of rotation, continuing reversed cam rotation past a second barrier and into contact with a second lobe to effect movement of said second barrier into said path of rotation after passage of said second surface of said circumferentially projecting construct of said cam, and continuing said reversed rotation until contact between said second surface of said circumferentially projecting construct and said second barrier halts rotation of said cam, forward rotation of said cam effecting movement of said second barrier out of said path of rotation.

24. The method of claim 23 wherein the socket is a slotted socket, the method further comprising the step of establishing a cam rotation start position indexed to a selected position of the slotted socket, said start position corresponding to cam position after reversed rotation is halted by contact between said second surface of said circumferentially projecting construct and said second barrier.

25. The method of claim 21 further comprising the steps of providing first and second circumferentially projecting formations at said circumferentially projecting construct of said cam, said surface at said first formation, axially differentiating said first and second formations so that said formations rotate in substantially different planes through said path of rotation, and positioning said lobe for contact by said second formation.

26. The method of claim 21 wherein contact of said lobe by said circumferentially projecting construct of said cam pivots said barrier into said path of rotation and said lobe out of said path of rotation, and wherein the step of reversing cam rotation to effect movement of said barrier out of said path of rotation includes contact of said barrier by said circumferentially projecting construct of said cam to effect movement of said barrier out of said path of rotation and thereby pivoting said lobe back into said path of rotation.

27. The method of claim 21 further comprising the step of manually manipulating said cam to a selected cam rotation start position to thereby effect selection of extent of rotation of the socket.

28. The method of claim 21 further comprising the step of positioning said barrier relative to said path of rotation so that when moved into said path of rotation after passage of said surface of said circumferentially projecting construct of said cam total forward rotation of said cam, and thereby the socket, before being halted by said contact between said surface of said circumferentially projecting construct and said barrier equals about 450°.

29. The method of claim 21 further comprising the steps of latching said barrier against movement into said path of rotation for a selected number of complete rotations of said cam, counting said selected number of complete rotations of said cam, and releasing said barrier after completion of said selected number of complete rotations of said cam for movement into said path of rotation responsive to said contact of said lobe by said circumferentially projecting construct of said cam.

* * * * *